US006376143B1

(12) United States Patent
Neely et al.

(10) Patent No.: US 6,376,143 B1
(45) Date of Patent: Apr. 23, 2002

(54) CHARGE GENERATION LAYERS COMPRISING TYPE I AND TYPE IV TITANYL PHTHALOCYANINES

(75) Inventors: Jennifer Kaye Neely; Catherine Mailhé Randolph, both of Longmont, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/964,031

(22) Filed: Sep. 26, 2001

(51) Int. Cl.[7] ..... G03G 5/047
(52) U.S. Cl. ..... 430/78; 430/59.5
(58) Field of Search ..... 430/78, 59.5, 135; 252/501.1; 106/412

(56) References Cited

U.S. PATENT DOCUMENTS

| | | | | |
|---|---|---|---|---|
| 4,882,427 A | | 11/1989 | Enokida et al. | 540/141 |
| 5,039,586 A | | 8/1991 | Itami et al. | 430/78 |
| 5,102,758 A | | 4/1992 | Kazmaier et al. | 430/58 |
| 5,213,929 A | | 5/1993 | Takano et al. | 430/78 |
| 5,418,107 A | | 5/1995 | Nealey et al. | 430/132 |
| 5,494,767 A | | 2/1996 | Itagaki et al. | 430/78 |
| 5,523,189 A | | 6/1996 | Molaire | 430/58 |
| 5,626,999 A | | 5/1997 | Itagaki et al. | 430/78 |
| 5,981,125 A | | 11/1999 | Itami | 430/56 |
| 6,001,523 A | | 12/1999 | Kemmesat et al. | 430/96 |
| 6,033,816 A | | 3/2000 | Luo et al. | 430/59.5 |
| 6,042,980 A | | 3/2000 | Kierstein et al. | 430/58.4 |
| 6,214,502 B1 | | 4/2001 | Srinivasan et al. | 430/58.4 |
| 6,245,471 B1 | | 6/2001 | Levin et al. | 430/58.4 |
| 6,322,940 B1 | * | 11/2001 | Nishigaki et al. | 430/59.5 |

* cited by examiner

*Primary Examiner*—John Goodrow
(74) *Attorney, Agent, or Firm*—John A. Brady

(57) ABSTRACT

Controlled sensitivity of a photoconductor is obtained employing both type I and type IV titanyl phthalocyanine in a charge generation layer. The type I titanyl phthalocyanine is preferably premilled before milling the mixture.

12 Claims, 6 Drawing Sheets

CHARGE GENERATION LAYERS COMPRISING TYPE I AND TYPE IV TITANYL PHTHALOCYANINES

FIELD OF THE INVENTION

The present invention is directed to charge generation layers which comprise a charge generation compound such as titanyl phthalocyanines. The invention is also directed to photoconductors including such charge generation layers.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner. Electrophotographic photoconductors may be a single layer or a laminate formed from two or more layers (multi-layer type and configuration).

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises the charge generation compound or molecule alone and/or in combination with a binder. A charge transport layer typically comprises a polymeric binder containing the charge transport compound or molecule. The charge generation compounds within the charge generation layer are sensitive to image-forming radiation and photogenerate electron hole pairs therein as a result of absorbing such radiation. The charge transport layer is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

Typically, the charge generation layer comprises a charge generating pigment or dye (phthalocyanines, azo compounds, squaraines, etc.), with or without a polymeric binder. Since the pigment or dye in the charge generation layer typically does not have the capability of binding or adhering effectively to a metal substrate, the polymer binder is usually inert to the electrophotographic process, but forms a stable dispersion with the pigment/dye and has good adhesive properties to the metal substrate. The electrical sensitivity associated with the charge generation layer can be affected by the nature of polymeric binder used. The polymeric binder, while forming a good dispersion with the pigment should also adhere to the metal substrate.

Improvement in print quality is always desirable, especially in the case of color printers since they exhibit an outstanding range of graphic capabilities. Such a range is a function of gray scale capabilities, and gray scale is obtained by printing intermixed color and background in patterns of very minute elements. This invention achieves improved gray scale by controlling photoconductor sensitivity so as to have more consistent response.

SUMMARY OF THE INVENTION

Such response is obtained in accordance with this invention by employing both type I titanyl phthalocyanine and type IV titanyl phthalocyanine. Surprisingly, these materials function by combining their level of photosensitivity so that the desired photosensitivity can be reliably reproduced. Preferably, the type I titanyl phthalocyanine is premilled before milling the mixture.

DETAILED DESCRIPTION OF THE DRAWINGS

The present invention as set forth in the detailed description will be more fully understood when viewed in connection with the drawings in which.

DETAILED DESCRIPTION

Figure 1:
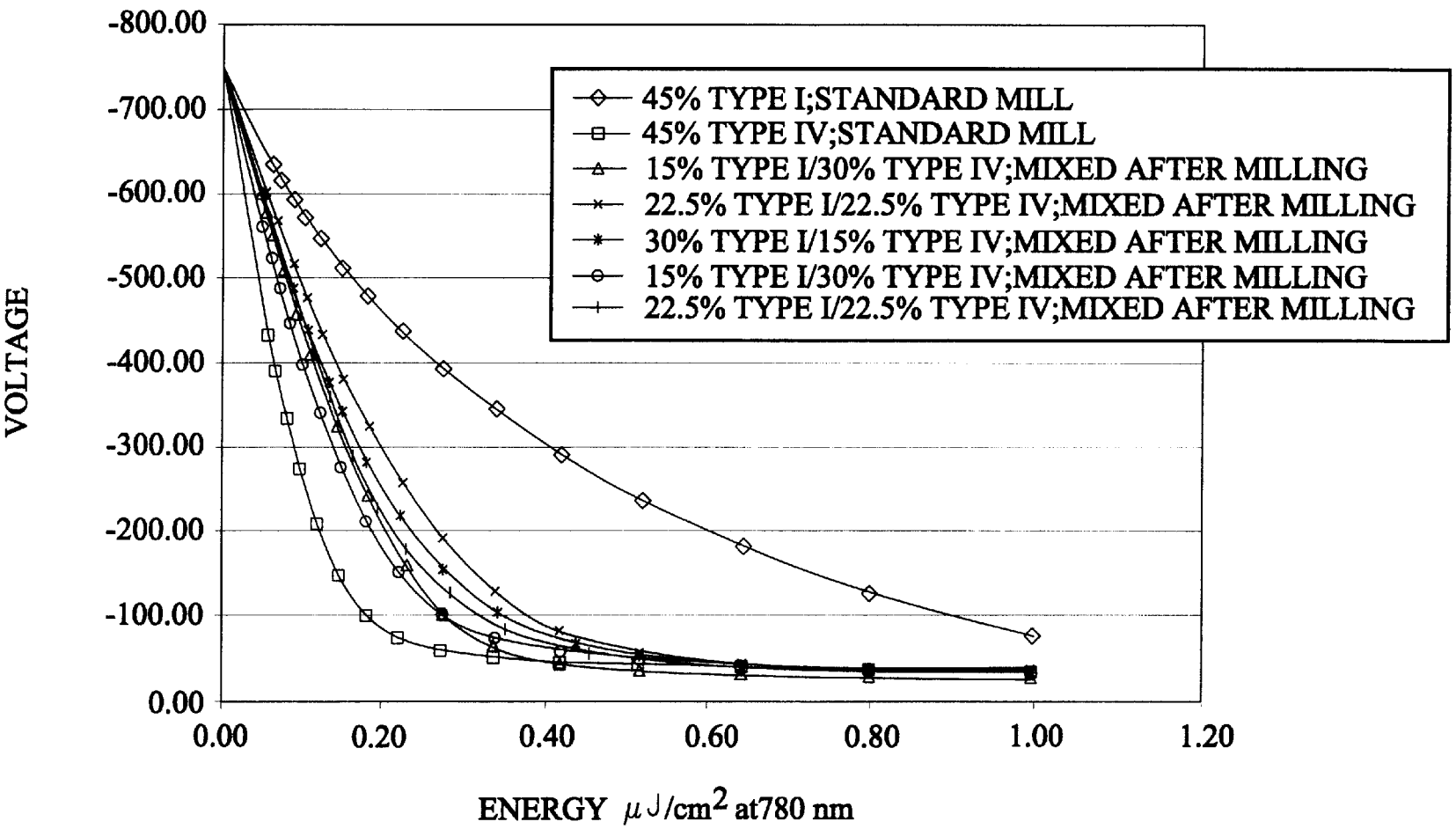
FIG. 1 is a discharge voltage versus energy plot for type I and type IV titanyl only and in mixtures.

One figure of merit for photoconductors is their V vs. E curves where V is the photoconductor voltage and E is the laser energy. These curves as shown below, FIG. 1, typically exhibit a "knee". For a given V vs. E curve, there is an optimal laser energy range which yields good gray scale, without compromising other print quality performances such as the optical density of a black page or the background level on a white page, (i.e. adequate development and background vectors). It appears that the adequate energy range for the laser print head lies in the vicinity of and below the "knee" of the curve. In the event where the print head power cannot be operated below a certain limit, such as 0.35 microJ/cm$^2$, in order to maintain good performance there is a need for tuning the "knee" of the V vs. E curve in the proper energy region. This invention recognizes that this tuning can be achieved by using a mixture of titanyl phthalocyanine pigments. Titanyl phthalocyanine exhibits many crystal forms, of interest here are type I and type IV. The V vs. E curves for different ratios of type I and type IV mixtures of titanyl phthalocyanine are shown below (FIG. 1, Table 1):

TABLE 1

| IV/I ratio | V @ 0.00 uJ/cm$^2$ | V @ 0.22 uJ/cm$^2$ | V @ 0.33 uJ/cm$^2$ | V @ 1 uJ/cm$^2$ | dark decay ls |
|---|---|---|---|---|---|
| 0/100 | −738.95 | −437.96 | −345.78 | −79.65 | 8.4 |
| 100/0 | −742.52 | −72.91 | −52.87 | −41.78 | 18.2 |
| 67/33 (a) | −744.58 | −164.24 | −61.38 | −28.94 | 23.2 |
| 50/50 (a) | −740.39 | −185.89 | −88.23 | −39.78 | 14.3 |
| 33/67 (a) | −739.31 | −259.43 | −130.86 | −35.36 | 15.7 |
| 67/33 (b) | −737.36 | −149.12 | −74.52 | −40.77 | 21.3 |
| 50/50 (b) | −734.56 | −217.81 | −105.40 | −39.40 | 19.9 |

Figure 2:
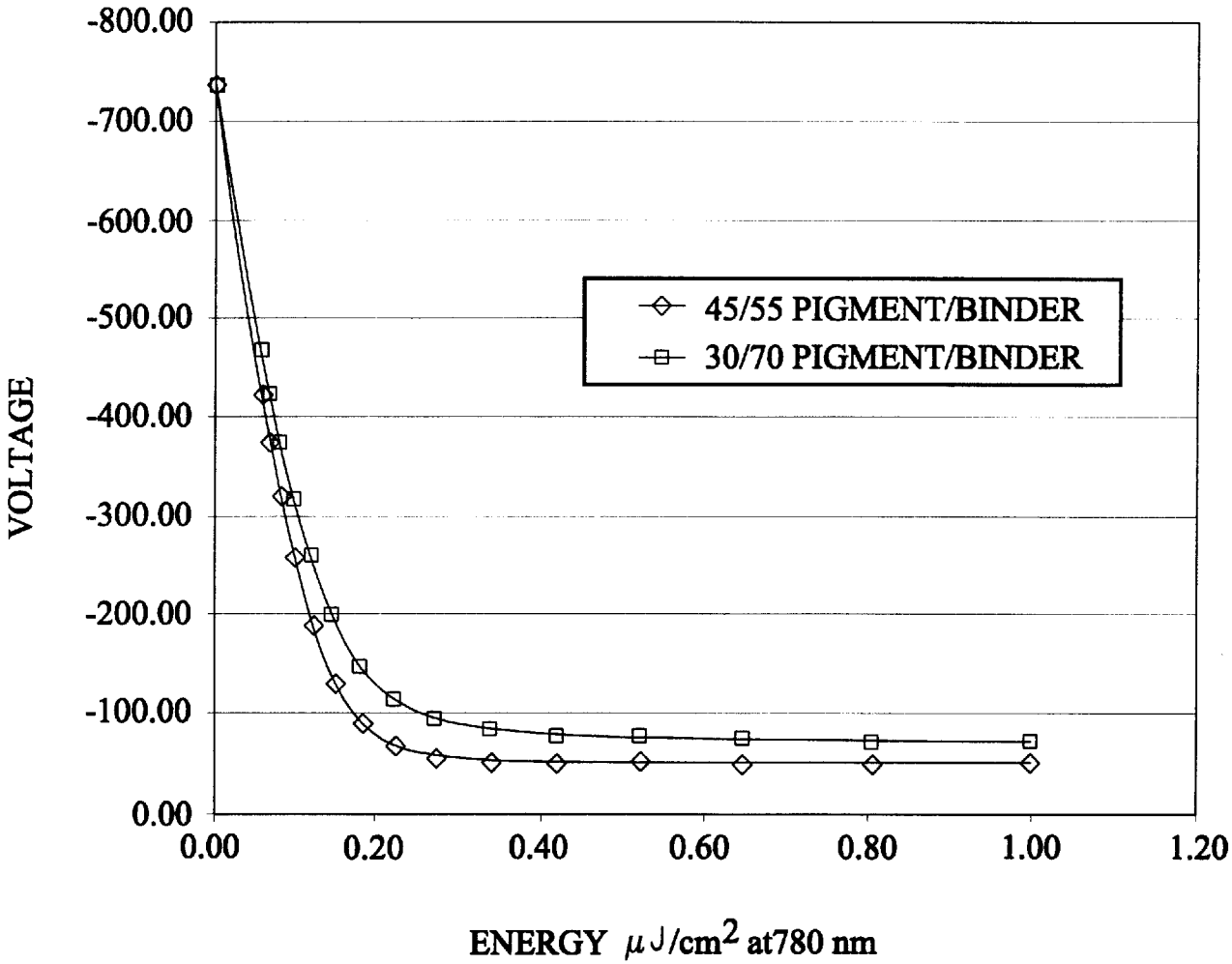
FIG. 2 is a discharge voltage versus energy plot illustrating the higher residual voltage obtained with a lower pigment ratio.

(a): dispersions were milled separately and then mixed
(b): type I and IV pigments were milled together In the low energy region of the V vs. E curve, the photoconductor's sensitivity is decreased with the addition of type I pigment whereas in the high-energy region of the curve, the photoconductor's residual voltage remains unchanged (or is even decreased). In other words the "knee" of the V vs. E curve can be moved along the energy axis (x axis) while leaving the residual voltage unchanged. This is an interesting feature of these pigment mixtures since some of the common formulation changes used to decrease sensitivity at low energies tend to increase the residual potential. Use of lower pigment to binder ratio, for example, will provide a decrease in sensitivity in low energy region but will also cause an increase in residual voltage, which is undesirable as shown in FIG. 2. When decreasing the pigment to binder ratio from 45/55 to 30/70, the voltage at 0.22 microJ/cm$^2$ increased by 47V (absolute values) but, the residual voltage increased by 21V.

Another well-known formulation tool used to decrease sensitivity at low energies, is to decrease the optical density of the CG layer. However, undesirable Moiré patterns appear in print at low CG optical densities for certain substrates. In fact a CG optical density of 1.4 or above is necessary to prevent Moiré patterns.

Also, all type I and type IV mixtures exhibit good dark decay performance, at least as good as in the case of 100% type IV (which will typically not be the case with lower pigment to binder ratio formulation).

Photoconductors with three different ratios of type I to type IV in the CG layer were evaluated for print quality, in particular gray scale range. The photoconductors were run for about 30,000 prints at ambient conditions. The laser print head power was constant at 0.6 microJ/cm$^2$. The electrostatic tester energy scale is different from that of the printer, with 0.7 microJ/cm$^2$ in the printer corresponding to about 0.35 microJ/cm$^2$ in the electrostatic tester. Data in FIG. 1 and FIG. 2 were obtained with the electrostatic tester and data in FIGS. 3, 4 and 5 were obtained with the printer.

In this case, the gray scale range was evaluated visually with a print master containing 127 levels of gray. The gray scale is bound at one end by the "black on white" box (BOW), which is the lightest discernable gray level (i.e. black dots on a white background). Conversely, the gray scale is bound at the other end by the "white on black" box (WOB), which is the darkest discernable gray level (i.e. white dots on a black background). In the case of the WOB side of the gray scale, a black diagonal line runs through the gray box to serve as a reference: once the diagonal line is no longer distinguishable from the gray background, the WOB limit has been reached. The gray scale range increases as type I content increases, as shown in Table 2.

TABLE 2

| Type I/Type IV ratio | 100% Type IV | 50% Type I 50% Type IV | 33% Type I 67% Type IV |
|---|---|---|---|
| WOB | 15 | 4 | 11 |
| BOW | 127 | 127 | 127 |

Other factors such as fatigue and changes to end of life were not remarkably different for the foregoing mixtures and the only type IV. Regarding other print quality characteristics, for example, the "all black" page optical density was rather independent of the type I content and fortunately did not get lighter with increasing amounts of type I. The background levels were equivalent for all dispersions.

Figure 3:
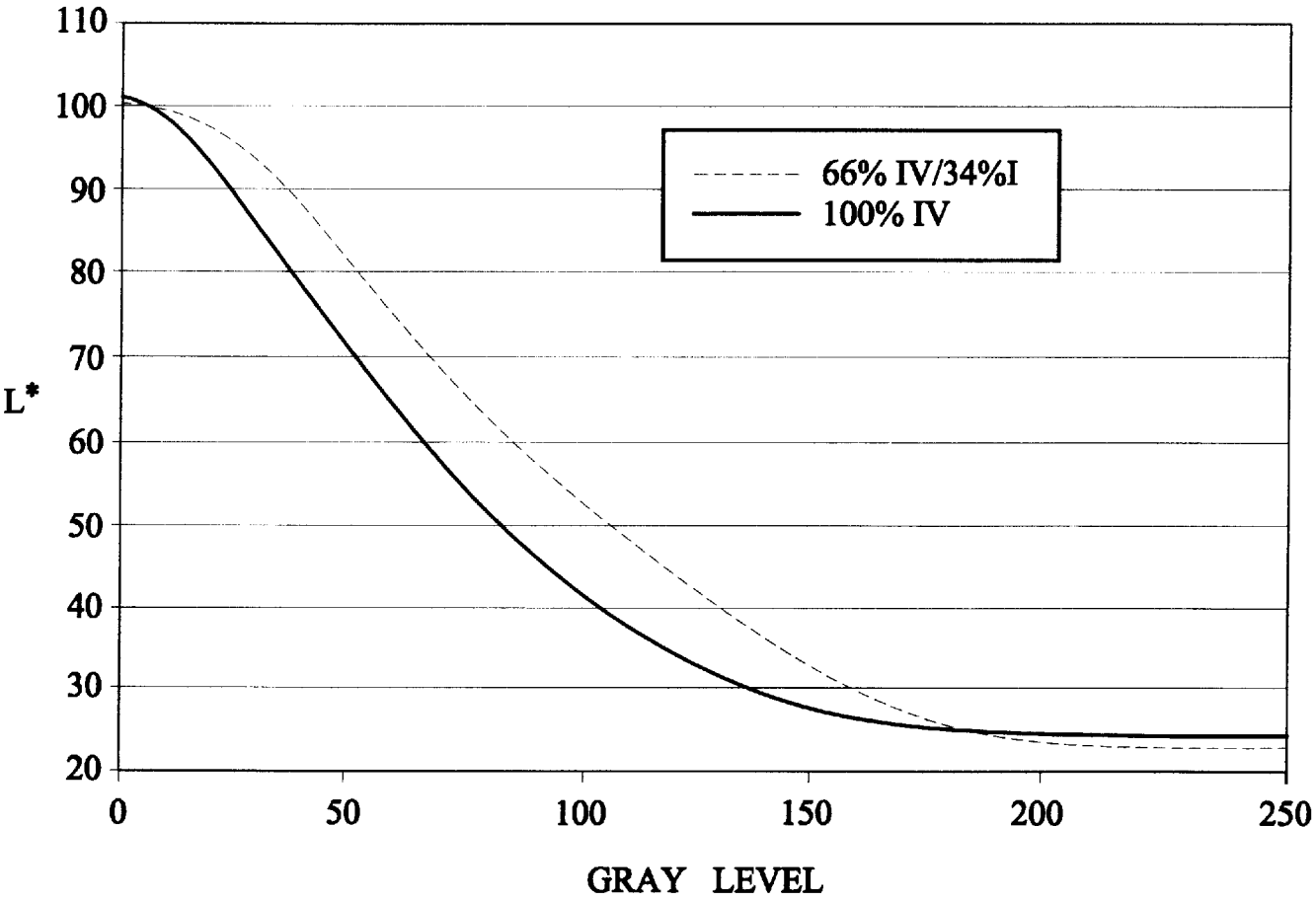
FIG. 3 illustrates L* versus gray levels plot for type IV alone and for a type I and type IV mixture.

Except for change in the knee of the voltage versus energy curve (FIG. 1), the mixtures appeared to be functionally the same as the only type IV. Gray scale improvement was also confirmed by measuring L* (lightness) vs. gray levels (FIG. 3). In this case the print master had 255 levels of gray. The ideal shape of such a curve for stability should be a straight line, which is never attained in reality. However, the curves with type I/type IV compositions are more linear than the corresponding 100% type IV composition, which is desirable. In FIG. 3, L* (lightness) is plotted against the different gray levels for 100% type IV and for 66% type IV and 34% type I.

The percentage of levels of discernable gray decreases slightly with optical density of the charge generation layer, but the influence of optical density is minor compared to that of laser energy and percentage of type I. Type I/type IV mixtures permit operation in the desirable 0.6 to 0.7 uj/cm$^2$ range without sacrificing gray scale range.

Table 3 illustrates that the gray scale range, measured as the percentage of perceivable gray levels out of a total 255 levels, increased with type I content and also increased with decreasing laser power.

TABLE 3

| Type I/Type IV ratio | 100% Type IV | 33% Type I 67% Type IV | 50% Type I 50% Type IV |
|---|---|---|---|
| 0.6 microJ/cm$^2$ | 76 | 81.5 | 83 |
| 0.7 microJ/cm$^2$ | 73.5 | 78.5 | 79.5 |

The foregoing data pertains to type I and type IV dispersions prepared on a laboratory scale.

Type I/Type IV Dispersions Made on a Manufacturing Scale

A similar gray scale evaluation was performed with type I/type IV dispersions prepared on a manufacturing scale. In this evaluation, the print master had 127 levels of gray. Again type I/type IV mixtures, 33/67 in this case, exhibit a significant improvement in gray scale range compared to 100% type IV (Table 4).

TABLE 4

| Drum ID | WOB | BOW | Gray Scale | Discharge 0.7 uJ | All Black OD | Slope (0.7 to 0.75) |
|---|---|---|---|---|---|---|
| 100% type IV | 20 | 125 | 105 | −44 | 1.67 | 67 |
| 67/33 type IV/I (a) | 13 | 124 | 111 | −75 | 1.65 | 173 |
| 67/33 type IV/I (b) | 12 | 124 | 112 | −89 | 1.67 | 220 |
| 67/33 type IV/I (c) | 10 | 123 | 113 | −77 | 1.67 | 200 |

The discharge voltages reported here were measured in the printer for two energy levels, 0.7 and 0.75 microJ/cm$^2$.

The type I/type IV mixtures yielded less sensitive photoconductors than the type IV alone. As desired, the optical density of the black page (all black OD) was not affected by the presence of the type I pigment. The 67/33 type IV/I CG dispersions (a) and (b) differed in their preparation (see following section). (a) did not have any pregrinding step for the type I pigment whereas (b) had 1 hour type I pregrinding step. 67/33 type I/IV (c) and (b) had the same CG, (c) was coated on a lab scale whereas (b) was coated on a manufacturing scale.

Figure 4:
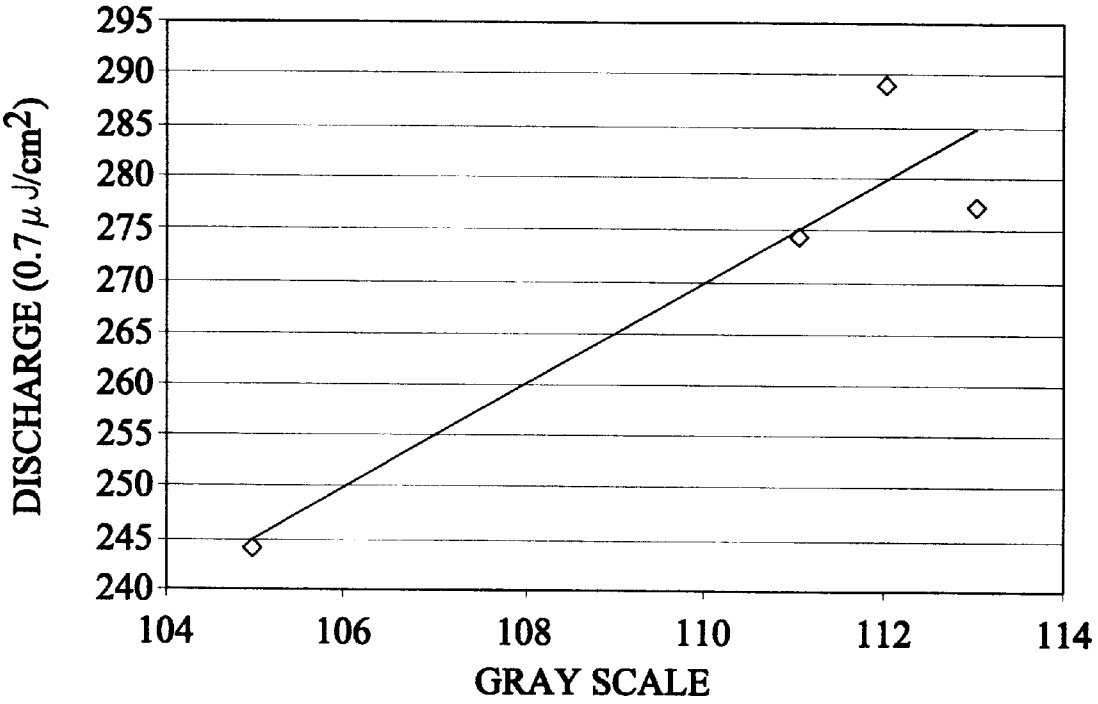
FIG. 4 illustrates discharge voltage versus discernable gray scale.
Figure 5:
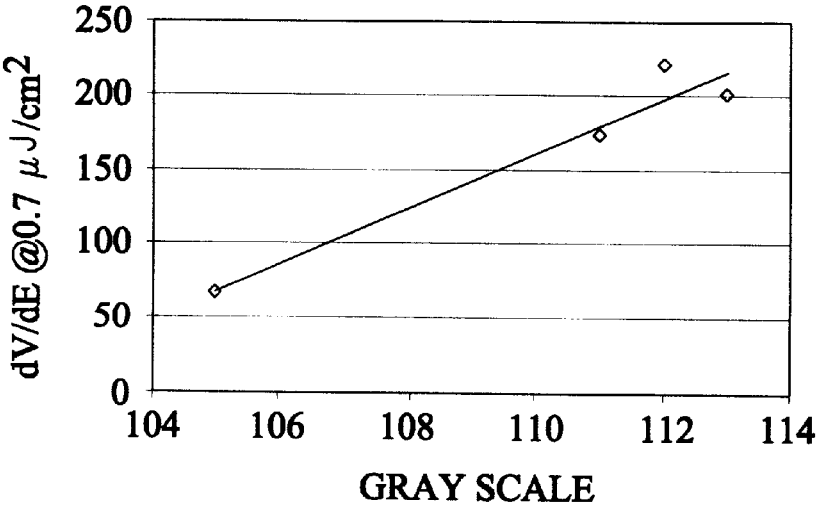
FIG. 5 illustrates the slope of the discharge voltage versus energy curve at 0.7 microJ/cm$^2$ versus discernable gray scale.

FIGS. 4 and 5 illustrate that gray scale range increases with decreasing sensitivity (FIG. 4) and that also, gray scale range increases with increasing slope of the V vs. E curve at the energy of interest (FIG. 5). The fact that gray scale improves when the slope of the V vs. E curve increases at the print head energy, means that an "L" shape for V vs. E curves is not preferred. In other words, the V vs. E curve should not be completely flat at the energy of interest (around 0.7 microJ/cm$^2$ in the printer or 0.35 microJ/cm$^2$ in the electrostatic tester, see FIG. 1). For example, in FIG. 1, the pure type IV curve is horizontal at 0.35 microJ/cm$^2$ whereas the I/IV mixtures have a downward slope.

Embodiments

The embodiment discussed in the foregoing and elaborated on below all employ a sealed, anodized aluminum core as conductive support, and a binder of equal parts by weight polyvinylbutyral (sold commercially as BX-55Z by Sekisui Chemical Co.) and epoxy resin (sold commercially as EPON 1004, by Shell Chemicals). The embodiments have an outer, charge transport layer, which obviously may vary widely without influencing this invention, since it involves the characteristics of charge generation layers. A representative charge transport layer, is a triarylamine or the like in a polycarbonate binder with small amounts of silicone microspheres and silicone oil.

Figure 6:
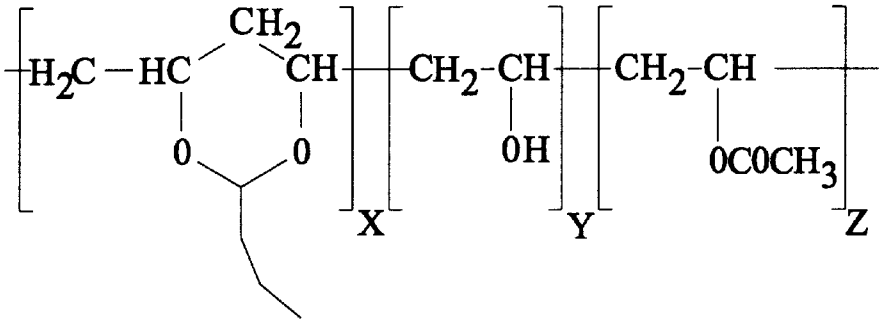
FIG. 6 is the structural formula of a polyvinylbutyral used as a binder.

BX-55Z polyvinylbutyral has a number average molecular weight, Mn, of about 98,000 g/mol and the general formula of FIG. 6 in which the units x, y and z (butyral, ethyl alcohol and acetate moieties, respectively) are somewhat random.

Figure 7:
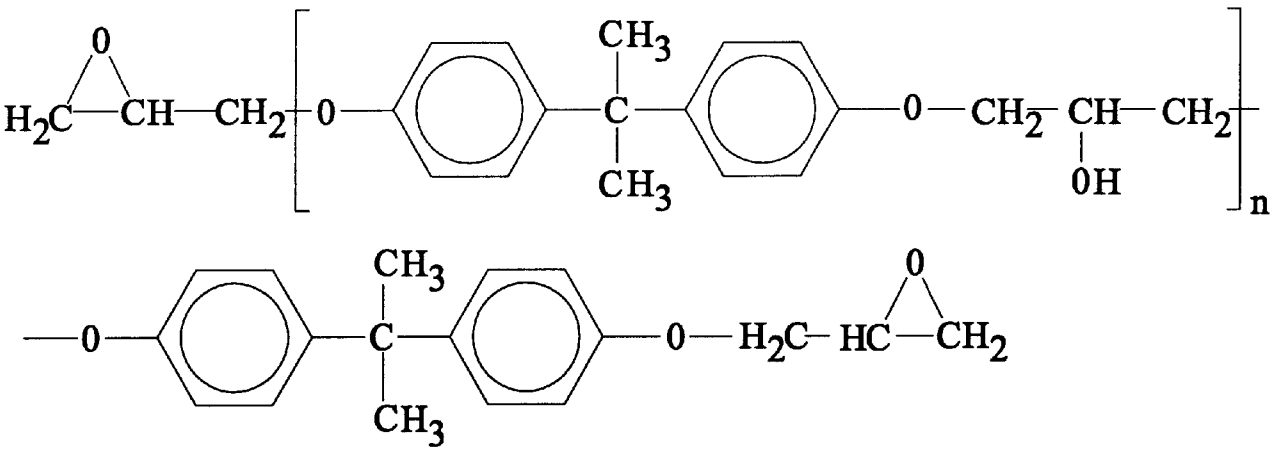
FIG. 7 is the structural formula of a epoxy resin used as a binder.

EPON 1004 is the reaction product of epichlorohydrin and bisphenol A, as shown in FIG. 7, with a weight average molecular weight, MW, of about 4,294 g/mol.

Dispersion Preparation

Pure type IV dispersions are prepared typically by milling a concentrated dispersion of type IV phthalocyanine pigment with binders (i.e. BX55Z polyvinylbutyral and EPON 1004) and solvents (methylethyl ketone and cyclohexanone) for a specified amount of time and then letting down the dispersion with solvents to the final solids content. It was found that the processing of type I type IV mixture dispersions had to be modified in order to obtain a dispersion that yielded good coating quality (as judged by visual inspection).

Type IV phthalocyanine is very sensitive to milling conditions and can undergo a phase transformation to a less photosensitive form under too harsh milling conditions. On the other hand, dispersions with small particle size are desirable since they tend (in general) to yield more uniform coatings. The demands of uniform coating and sensitivity have therefore to be balanced. In addition, type I dispersions tend to require more milling than type IV to obtain dispersions with good "coatability". It was therefore determined that a preferred method for milling type I/IV dispersions was to premill type I before introducing the type IV pigment. All mills, including laboratory mills, were agitator bead mills. Other mills should be suitable.

Processing steps for the different dispersions (pure type IV titanyl phthalocyanine and mixed type I and type IV are summarized in tables 5 and 6. (Note: the milling times given below refer to residence times in the milling chamber; MEK refers to methylethyl ketone.)

TABLE 5

(100% type IV, no premilling, all weights in grams)

| | Mill Base | Let Down | Total Formulation |
|---|---|---|---|
| Type IV | 75.61 | 0 | 75.61 |
| BX55Z | 16.38 | 29.82 | 46.21 |
| EPON 1004 | 8.82 | 37.38 | 46.21 |
| Cyclohexanone | 322.6 | 84.85 | 407.45 |
| MEK | 80.65 | 4944.57 | 5025.22 |

TABLE 6

(33% type 1/67% IV mixture with type I premilled, all weights in grams)

| | Pregrind | Mill Base | Let Down | Total Formulation |
|---|---|---|---|---|
| Type IV | 0 | 116.7 | 0 | 116.7 |
| Type I | 58.34 | 58.34 | 0 | 58.34 |
| BX55Z | 0 | 37.92 | 69.04 | 106.97 |
| EPON 1004 | 0 | 20.42 | 86.55 | 106.97 |
| Cyclohexanone | 256.7 | 746.83 | 196.43 | 943.26 |
| MEK | 171.13 | 186.71 | 11446.87 | 11633.58 |

Figure 8:
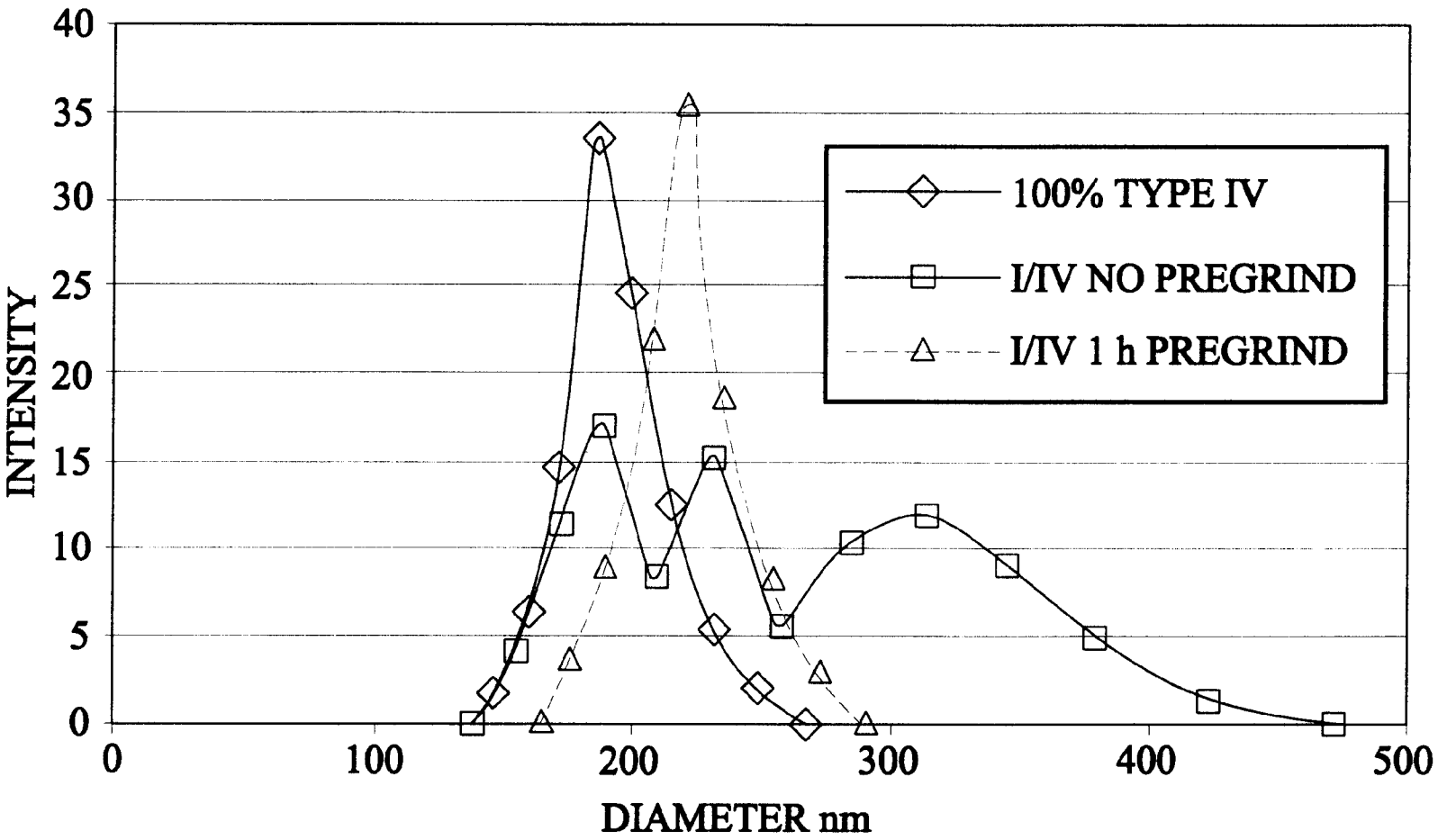
FIG. 8 is a plot of particle size distribution for different dispersions and preparation methods.

The different dispersions were characterized in terms of their particle size, using a Malvern Zeta sizer IV. Also, these particular dispersions were prepared on a "scale-up" mill of intermediate capacity between a laboratory scale mill and a manufacturing mill. The particle size distribution is shown in FIG. 8, and the average particle size is summarized in Table 7.

TABLE 7

| # | Dispersion | Avg diameter nm | Polydispersity |
|---|---|---|---|
| A | 100% type IV | 194.4 | 0.055 |
| B | 67/33 type IV/I no pregrind | 220.1 | 0.190 |
| C | 67/33 type IV/I pregrind 1 h | 213.5 | 0.127 |

A 100% type IV: 45/55 pigment to binder ratio with type IV titanyl phthalocyanine pigment and 50/50 BX55Z PVB/EPON binder
B I/IV no pregrind: 67/33 IV/I pigment with the same pigment to binder ratio and ratio of binders as dispersion A.
C I/IV 1 hour pregrind: Same dispersion composition as dispersion B but with 1 hour pregrind.

Dispersion A (100% type IV) had the lowest average particle size of the three and appeared rather monomodal. Dispersion B (67/33 IV/I, no pregrind), had the highest particle size and was polydisperse. Dispersion C exhibited a reduced average particle size compared to dispersion B although not quite as small as that of dispersion A; more importantly its polydispersity appears reduced compared to dispersion B.

Duration of the pregrinding step was optimized. Table 8 shows that overgrinding type I in the pregrinding step could lead to a decrease of sensitivity as well as an increase in particle size.

TABLE 8

| # | Type I pregrind | V @ 0.33 $\mu J/cm^2$ | V @ 1 $\mu J/cm^2$ | Average Diameter nm | Polydispersity |
|---|---|---|---|---|---|
| D | No Pre-Grind | −84 | −49 | 224.2 | 0.14 |
| E | 1 Hour Pre-Grind | −75 | −42 | 215.8 | 0.09 |
| F | 2 Hour Pre-Grind | −91 | −45 | 223.8 | 0.12 |

One (1) hour pregrind appeared to be the optimal pregrinding time. One possible explanation for this increase in particle size, is that pigment particles reagglomerate as they get smaller. To alleviate this issue, the milling procedure was modified to include an additional step, called here "binder stabilization step".

Additional Binder Stabilization Step

This modified milling process comprised the following steps:

Pregrind type I pigment with solvents

Binder stabilization step: add binders to mill base and additional premilling

Add type IV (as dry pigment to mill base) and milling step

Let down step

TABLE 9

| | Pregrind | Binder Stabilization | Mill Base | Let Down | Total Formulation |
|---|---|---|---|---|---|
| Type IV | 0 | 0 | 116.7 | 0 | 116.7 |
| Type I | 58.34 | 58.34 | 58.34 | 0 | 58.34 |
| BX55Z | 0 | 37.92 | 37.92 | 69.04 | 106.97 |
| EPON 1004 | 0 | 20.42 | 20.42 | 86.55 | 106.97 |
| Cyclo-hexanone | 256.7 | 746.83 | 746.83 | 196.43 | 943.26 |
| MEK | 171.13 | 186.71 | 186.71 | 11446.87 | 11633.58 |

In Table 9, "Pregrind", "Binder Stabilization", "Mill base" refer to the composition of the different dispersions being milled during, respectively, the pregrinding step, the binder stabilization step and the overall milling step. The let down is a solution of BX55Z and EPON 1004 in cyclohexanone and MEK and is added to the mill base during the last processing step to yield the final dispersion. In the binder stabilization step, the binders EPON and BX55Z are typically dissolved in the MEK/cyclohexanone solvent mixture before being added to the mill base mixture.

Table 10 refers to dispersions prepared on a laboratory scale, which accounts for the higher values for particle size. Dispersions processed in the laboratory scale mill exhibit typically higher particle size than dispersions of the same composition processed in the scale-up mill or the manufacturing scale mill. The binder stabilization step resulted in a decrease in average particle size: as desired, the binder stabilization step may have prevented re-agglomeration or the additional milling time contributed to a reduced particle size. Improvement in the overall CG coating quality (as judged by visual observation) was also observed. The discharge voltage at 0.33 microJ/$cm^2$ was about 13 V higher for the binder stabilized dispersion, which is still within desirable range.

TABLE 10

| # | Pre-milling (h) | Binder Stab. (h) | mill-ing (h) | V@0.33 $\mu J/cm^2$ | V@0.33 $\mu J/cm^2$ | average diameter nm | poly disp |
|---|---|---|---|---|---|---|---|
| G | 1.5 | 0 | 1 | −75.87 | −36.28 | 288.6 | 0.30 |
| H | 1.5 | 0.5 | 1 | −89.05 | −48.03 | 254.9 | 0.07 |

Both types of dispersion processing (i.e. type I premilling/type I/IV milling or type I premilling/binder pre-stabilization step/type I/IV milling) were scaled-up at the manufacturing level. Both types of processing yielded dispersions with similar particle size and the desired electrical performance. Perhaps, the binder stabilization step offers some advantage in as much as it offers some protection against a possible overmilling of the type I pigment and against the ensuing increase in particle size and coating quality issues.

The times given in the examples for the different milling steps will vary according to the type of mill used.

The binders used in these type I/type IV dispersions included only EPON 1004 and BX55Z. The use of type I/type IV mixtures for improved gray scale could also be extended to other binder systems such as the ones containing polysiloxanes as an additional binder.

Variations in the binder or binders, the conductive substrate, the charge transfer layer and the like do not materially influence the electrical characteristics of a mixture of type I and type IV titanyl phthalocyanine employed by this invention.

What is claimed is:

1. A photoconductor comprising a conductive support layer, a charge generation layer having photosensitive material in a resin binder, and a charge transfer layer wherein the improvement comprises said photosensitive material being a mixture of type I titanyl phthalocyanine and type IV titanyl phthalocyanine.

2. The photoconductor as in claim 1 in which said mixture is about 33 percent of type I titanyl phthalocyanine and about 67 percent of type IV titanyl phthalocyanine.

3. The photoconductor as in claim 1 also characterized by said resin binder being a mixture of polyvinylbutyral and an epoxy resin which is the reaction product of epichlorohydrin and bisphenol A.

4. The photoconductor as in claim 2 also characterized by said resin binder being a mixture of polyvinylbutyral and an epoxy resin which is the reaction product of epichlorohydrin and bisphenol A.

5. The photoconductor as in claim 1 further characterized by said type I titanyl phthalocyanine having been premilled in a dispersion, and said type I phthalocyanine and said type IV phthalocyanine subsequently being combined and further milled.

6. The photoconductor as in claim 2 further characterized by said type I titanyl phthalocyanine having been premilled in a dispersion, and said type I phthalocyanine and said type IV phthalocyanine subsequently being combined and further milled.

7. The photoconductor as in claim 3 further characterized by said type I titanyl phthalocyanine having been premilled in a dispersion, and said type I phthalocyanine and said type IV phthalocyanine subsequently being combined and further milled.

8. The photoconductor as in claim 4 further characterized by said type I titanyl phthalocyanine having been premilled in a dispersion, and said type I phthalocyanine and said type IV phthalocyanine subsequently being combined and further milled.

9. The photoconductor as in claim 5 further characterized by said premilling being first with no binder resin in the dispersion and then with said binder resin in the dispersion.

10. The photoconductor as in claim 6 further characterized by said premilling being first with no binder resin in the dispersion and then with said binder resin in the dispersion.

11. The photoconductor as in claim 7 further characterized by said premilling being first with no binder resin in the dispersion and then with said binder resin in the dispersion.

12. The photoconductor as in claim 8 further characterized by said premilling being first with no binder resin in the dispersion and then with said binder resin in the dispersion.

* * * * *